US006043463A

United States Patent [19]

Plumptre

[11] Patent Number: 6,043,463

[45] **Date of Patent: *Mar. 28, 2000**

[54] ELECTRIC HEATER

[75] Inventor: David Aubrey Plumptre, Droitwich, United Kingdom

[73] Assignee: Ceramaspeed Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,224

[22] Filed: Mar. 11, 1998

[30] Foreign Application Priority Data

Apr. 25, 1997 [GB] United Kingdom ..... 9708338

[51] Int. Cl.[7] ..... H05B 3/68; F24C 15/10

[52] U.S. Cl. ..... 219/460.1; 219/468.1; 126/211

[58] Field of Search ..... 219/443.1, 460.1, 219/401.1, 463.1, 468.1, 468.2; 126/211, 217, 90 A, 92 AC, 92 B

[56] References Cited

U.S. PATENT DOCUMENTS

| | | | |
|---|---|---|---|
| 2,752,477 | 6/1956 | Norris . | |
| 4,388,520 | 6/1983 | McWilliams | 219/460.1 |
| 4,833,288 | 5/1989 | Poumey | 219/10.493 |
| 5,374,807 | 12/1994 | Yahav et al. | 219/465.1 |

FOREIGN PATENT DOCUMENTS

| | | |
|---|---|---|
| 2727300 | 5/1996 | France . |
| 2-186587 | 7/1990 | Japan . |
| 2170590 | 6/1986 | United Kingdom . |
| 2180637 | 4/1987 | United Kingdom . |

OTHER PUBLICATIONS

European Search Report EP98 30 2473.

*Primary Examiner*—Sang Paik
*Attorney, Agent, or Firm*—Ira S. Dorman

[57] ABSTRACT

A radiant electric heater is provided with at least one covering sheet (7) made of mica which is at least partially transparent. The at least partially transparent mica may be in the form of natural mica.

23 Claims, 1 Drawing Sheet

ELECTRIC HEATER

This invention relates to radiant electric heaters which are provided with a covering sheet. Such heaters may include one or more heating elements which is or are supported on or adjacent to a base of thermal and/or electrical insulation material.

DESCRIPTION OF PRIOR ART

Such heaters are well known, particularly in cooking appliances, in which one or more heating elements such as of coiled wire form, or of ribbon form, or of lamp form, is or are supported on or adjacent to a base of insulation material which may be provided in a support dish such as of metal. It is particularly well known and advantageous to use, as a base, compacted particulate microporous thermal insulation material.

Heaters of this kind have generally been used beneath a sheet of glass-ceramic material in a smooth top cooking appliance or behind such a sheet in oven or grill applications. One example of a radiant heater incorporating a glass-ceramic sheet is known from GB-A-2 170 590.

It is well known that cooking operations are commonly accompanied by issuance of steam and other vapours and spillages and that splattering of liquids and food particulates occur on and in cooking appliances. The sheet of glass-ceramic material normally prevents contact between the heater and such vapours, liquids and particulates. However such glass-ceramic material is expensive and also reduces the thermal performance of the heater.

There are applications for heaters, such as in ovens, grills, deep fat fryers, where it would be desirable to dispense with the use of a glass-ceramic sheet. However it is known that microporous insulation materials are seriously degraded when exposed to steam, water and other liquids or vapours and can also be damaged by contact with some particulate materials.

Furthermore, damage to the heating element may also occur by exposure to some liquids, vapours or particulate materials.

It is also possible that, when a heater is located in an inverted orientation in a cooking appliance, particles of insulation material from the heater may fall into a cooking area of the appliance, which may be disadvantageous.

OBJECT OF THE INVENTION

It is an object of the present invention to overcome or minimise these problems.

SUMMARY OF THE INVENTION

The present invention provides a radiant electric heater provided with at least one covering sheet, wherein the covering sheet comprises mica which is at least partially transparent.

The at least partially transparent mica may comprise natural mica.

The heater may include at least one electrical heating element of wire, ribbon or lamp form. A base of insulation material may be provided, such as of microporous thermal insulation material, having supported relative thereto (that is, on or adjacent to the base) the at least one electrical heating element.

The microporous thermal insulation material may be compacted into a dish-like support, such as of metal.

The at least one covering sheet of at least partially transparent mica is suitably provided spaced from the at least one electrical heating element.

A peripheral wall of thermal insulation material may be provided for the heater. The at least one covering sheet of at least partially transparent mica may be arranged in contact with an outer surface of the peripheral wall.

An apertured member may be provided in contact with the at least one covering sheet of at least partially transparent mica. The apertured member may serve as a support for the at least one covering sheet and/or as an electrical screen for the heater. Such apertured member may comprise a perforated sheet of metal, ceramic or other suitable refractory material.

The heater of the invention is particularly applicable to cooking appliances such as grills, ovens, especially microwave ovens, deep fat fryers.

The at least partially transparent mica applied in sheet form is economically advantageous compared to high temperature withstanding glass or glass-ceramic sheet form materials. Such transparent mica can be applied as a thin sheet, for example of the order of 50 microns in thickness, and exhibits low thermal mass. It also possesses good transmission of visible and infra-red radiation and because of its excellent electrical insulation properties, closer proximity between the heating elements in the heater and adjacent metal components of an appliance in which the heater is used can be tolerated compared with the prior art.

Furthermore, the at least one sheet of at least partially transparent mica serves as a barrier to vapours and particulate materials, such as arising from cooking operations, and prevents such vapours and particulate materials from contacting the one or more heating elements in the heater and also insulation provided in the heater.

The invention is now described by way of example with reference to the accompanying drawings, in which:

DESCRIPTION OF PREFERRED EMBODIMENT

Figure 1:
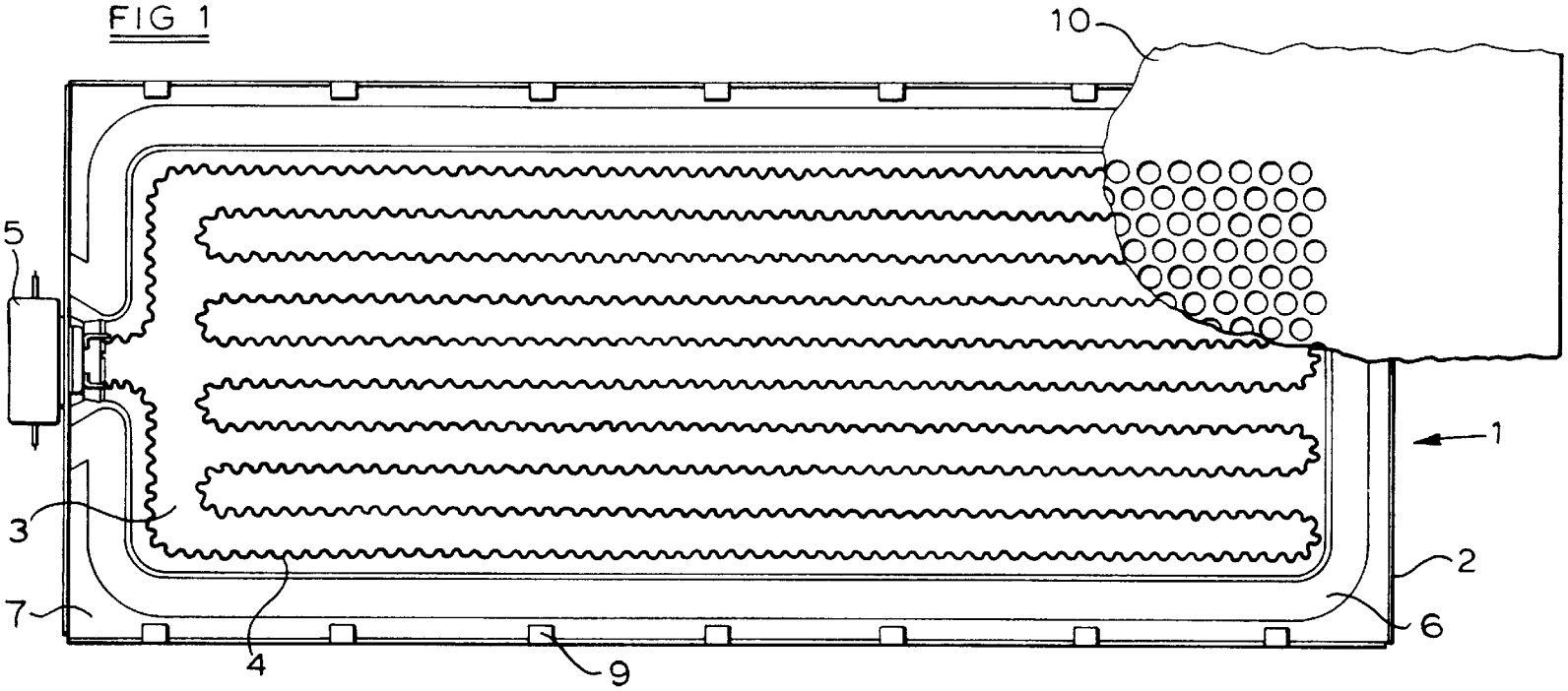
FIG. 1 is a bottom plan view of a radiant electric heater according to the invention.
Figure 2:
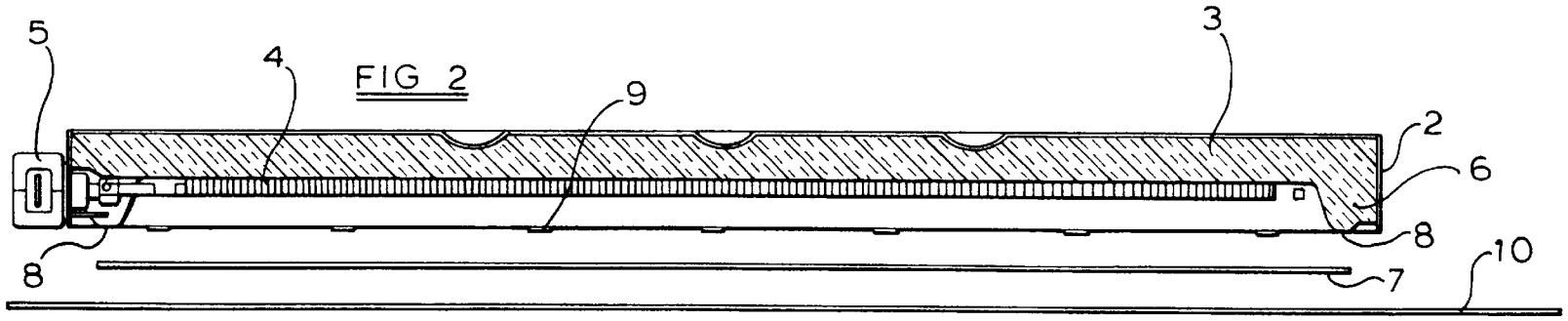
FIG. 2 is a cross-sectional view, in partly exploded form, of the heater of FIG. 1.

Referring to the drawings, a radiant electric heater 1 for a cooking appliance (not shown) comprises a metal dish-like support 2 provided with a base layer 3 of compacted microporous thermal insulation material. A heating element 4 is provided secured to the base layer 3. As shown, the heating element 4 comprises a corrugated metal ribbon mounted edgewise on the base layer 3 and secured by partial embedding in the base layer 3. Such a heating element is well known to the skilled person. The heating element 4 could instead be of coiled wire or coiled ribbon form or of lamp form or of any other form known to the skilled person. More than one form of heating element could also be provided in the heater.

A terminal block 5 for the heating element is mounted on the heater and allows the heater to be connected to a voltage supply for operation.

A peripheral wall 6 of thermal insulation material is provided in the heater. As shown, this wall is integral with the base layer 3. However it could be provided as a separate member, as is well known in the art.

In order to prevent contact with internal components of the heater, such as the heating element 4 and insulation 3, by vapours and/or particulate materials during operation of the heater, for example in a cooking appliance, at least one sheet 7 of at least partially transparent natural mica is provided. Such sheet 7 contacts the outer surface 8 of the peripheral wall and covers the heater and is suitably secured by bent over tags 9, such as of metal and which may be integral with the metal support 2. If desired, there may be more than one sheet 7. For maximum thermal efficiency the sheet or sheets 7 should be as thin as is practically possible and may typically be about 50 microns thickness overall. Such at least partially transparent natural mica is sometimes referred to as clear natural mica and allows adequate transmission therethrough of visible and infra-red radiation from the heating element 4.

A perforated sheet 10 is optionally provided overlying the one or more sheets 7 of substantially transparent mica. Such perforated sheet 10 may serve a twofold purpose. It provides support for the mica sheet or sheets 7, enabling the thickness of the sheet or sheets 7 to be minimised and can comprise a metal or a ceramic, or other suitable refractory material. In applications of the heater such as in microwave ovens, where electrical screening of the heater is required in respect of electromagnetic radiation generated elsewhere in the oven, the perforated sheet 10, formed of metal, also or alternatively fulfils this screening function.

What is claimed is:

1. A radiant electric heater provided with only one single continuous covering sheet consisting solely of mica which is at least partially transparent.

2. A heater according to claim 1, wherein the at least partially transparent mica comprises naturally occurring mica.

3. A heater according to claim 1, wherein there is provided at least one electrical heating element selected from wire, ribbon and lamp form.

4. A heater according to claim 3, wherein a base of insulation material is provided having supported relative thereto the at least one electrical heating element.

5. A heater according to claim 4, wherein the insulation material comprises microporous thermal insulation material.

6. A heater according to claim 5, wherein the microporous insulation material is compacted into a dish-like support.

7. A heater according to claim 6, wherein the dish-like support comprises metal.

8. A heater according to claim 3, wherein the at least one covering sheet of at least partially transparent mica is provided spaced from the electrical heating element.

9. A heater according to claim 1, wherein a peripheral wall of thermal insulation material is provided.

10. A heater according to claim 9, wherein the covering sheet of at least partially transparent mica is arranged in contact with an outer surface of the peripheral wall.

11. A heater according to claim 1 further including, an apertured member overlying the covering sheet of at least partially transparent mica.

12. A heater according to claim 11, wherein the apertured member comprises a perforated sheet selected from metal, ceramic and other suitable refractory material.

13. A radiant electric heater provided with only one single continuous covering sheet, the covering sheet consisting solely of mica which is at least partially transparent; and an apertured member, consisting of metal, overlying the covering sheet.

14. A heater according to claim 13, wherein the at least partially transparent mica comprises naturally-occurring mica.

15. A heater according to claim 13, wherein there is provided at least one electrical heating element selected from wire, ribbon, and lamp form.

16. A heater according to claim 15, wherein a base of insulation material is provided having supported relative thereto the at least one electrical heating element.

17. A heater according to claim 16, wherein the insulation material comprises microporous thermal insulation material.

18. A heater according to claim 17, wherein the microporous insulation material is compacted into a dish-like support.

19. A heater according to claim 18, wherein the dish-like support comprises metal.

20. A heater according to claim 15, wherein the covering sheet is provided spaced from the at least one electrical heating element.

21. A heater according to claim 13, wherein a peripheral wall of thermal insulation material is provided.

22. A heater according to claim 21, wherein the covering sheet is arranged in contact with an outer surface of the peripheral wall.

23. A heater according to claim 13, wherein the apertured member is a perforated sheet.

* * * * *

UNITED STATES PATENT AND TRADEMARK OFFICE

CERTIFICATE OF CORRECTION

PATENT NO. : 6,043,463

DATED : March 28, 2000

INVENTOR(S) : David Aubrey Plumptre

It is certified that error appears in the above-indentified patent and that said Letters Patent is hereby corrected as shown below:

Column 3, line 28, insert in Claim 1, after the word "sheet," the phrase ", the covering sheet."

Column 3, line 45, delete from Claim 8 the phrase "at least one."

Signed and Sealed this

Third Day of April, 2001

*Attest:*

Nicholas P. Godici

NICHOLAS P. GODICI

*Attesting Officer*

*Acting Director of the United States Patent and Trademark Office*